US005461956A

United States Patent [19]

Petersen et al.

[11] Patent Number: 5,461,956

[45] Date of Patent: Oct. 31, 1995

[54] VARIABLE THICKNESS BREAD SLICER

[75] Inventors: Bernard L. Petersen, Marne; Alan M. Ledford, Coopersville; Gary L. Kruse, Spring Lake, all of Mich.

[73] Assignee: Oliver Products Company, Grand Rapids, Mich.

[21] Appl. No.: 9,865

[22] Filed: Jan. 27, 1993

[51] Int. Cl.[6] ..... B26D 1/16; B26D 5/20

[52] U.S. Cl. ..... 83/221; 83/241; 83/277; 83/283; 83/370; 83/470

[58] Field of Search ..... 83/206, 209, 210, 83/211, 221, 238, 240, 241, 277, 283, 370, 409, 490, 234, 703

[56] References Cited

U.S. PATENT DOCUMENTS

| | | | |
|---|---|---|---|
| 15,163 | 6/1856 | Arnold . | |
| 445,505 | 1/1891 | Harreld et al. . | |
| 667,364 | 2/1901 | Graff . | |
| 898,163 | 9/1908 | Andersen . | |
| 1,179,836 | 4/1916 | Johnson . | |
| 1,181,016 | 4/1916 | Knudson . | |
| 1,841,996 | 1/1932 | Van Berkel . | |
| 1,951,678 | 3/1934 | Schmitt | 83/277 |
| 2,107,968 | 2/1938 | Uline . | |
| 2,534,001 | 12/1950 | Couse . | |
| 2,598,480 | 5/1952 | Wright . | |
| 2,617,176 | 11/1952 | McClellan et al. | 83/222 |
| 2,840,125 | 6/1958 | Kirksey . | |
| 3,016,932 | 1/1962 | Jacobson . | |
| 3,213,731 | 10/1965 | Renard | 83/490 |
| 3,213,734 | 10/1965 | Nystrand | 83/490 |
| 3,707,103 | 12/1972 | Tishken | 83/277 |
| 3,724,306 | 4/1973 | Meckley | 83/210 |
| 3,776,073 | 12/1973 | Runge | 83/241 |
| 3,831,469 | 8/1974 | Vadas . | |
| 3,954,035 | 5/1976 | Hauberg . | |
| 4,549,458 | 10/1985 | Townsend . | |
| 4,552,049 | 11/1985 | Matzinger et al. | 83/277 |
| 4,958,547 | 9/1990 | Low . | |

FOREIGN PATENT DOCUMENTS

| | | |
|---|---|---|
| 3009663A1 | 9/1980 | Germany . |
| 3232045A1 | 3/1984 | Germany . |
| 3536202A1 | 4/1987 | Germany . |
| 938916 | 5/1982 | U.S.S.R. . |
| 432208 | 8/1935 | United Kingdom . |

OTHER PUBLICATIONS

European Search Report for Application No. EP 94 30 0595, including list of documents considered to be relevant. 1994.

"Herlitzius Brotschneidemaschinen" published by Gebrüder Herlitzius GmbH & Co., West Germany, date unknown.

*Primary Examiner*—Kenneth E. Peterson

*Attorney, Agent, or Firm*—Price, Heneveld, Cooper, DeWitt & Litton

[57] ABSTRACT

A powered bread slicer capable of slicing successive loaves of bread to selected different slice thicknesses. A rotating circular bread slicing knife is mounted on a pivotal, reciprocal arm for shifting the knife from a retracted position through slicing positions between and transverse to an infeed table and an outfeed table, and return to the retracted position. The slice thickness is selected, as for standard one-half inch thickness, deli one-quarter to three-eighths inch thickness, garlic or French bread up to one inch thickness, or otherwise. A variable stepper motor incrementally advances a loaf pusher one step at a time, the dimension of the step being of the selected slice thickness dimension. The distance by the travelled loaf pusher to reach the end of its travel is monitored to determine whether the bread heal is thick enough to slice once more. This decision is a function of the selected slice thickness dimension. A detector sensing the leading end of the loaf initially activates the slicer knife drive and the support arm drive. A pusher detector adjacent the knife prevents knife advancement with presence of the pusher adjacent the knife, allowing the pusher to move past the knife to push the fully sliced loaf completely onto the discharge table, and then return to the infeed table.

11 Claims, 18 Drawing Sheets

INPUTS:

| | | |
|---|---|---|
| HOME | = | L.S. 108 |
| END1 | = | L.S. 112a |
| END2 | = | L.S. 112b |
| ARM | = | 1 PRX 29 |
| DOOR | = | 1 CR 146 |
| SCNNR | = | 1 PR/2 PR 19a, 19b |
| START | = | START PB 118 |
| STOP | = | STOP PB 120 |

THE HOME, END1, AND END2 LIMIT SWITCHES ARE NORMALLY CLOSED, AND OPEN WHEN ACTUATED.
THE 1 CR DOOR CONTACT IS CLOSED, AND OPENS WHEN ANY DOOR IS OPENED.
THE SCANNER INPUTS (19a and 19b) ARE CLOSED, AND OPEN WHEN PRODUCT BREAKS THE SCANNER BEAM.
THE START SWITCH IS NORMALLY OPEN.
THE STOP SWITCH IS NORMALLY CLOSED, AND OPENS WHEN DEPRESSED.

Fig. 12

VARIABLE THICKNESS BREAD SLICER

BACKGROUND OF THE INVENTION

This invention relates to bread slicing machines, and more particularly to a variable thickness bread slicer as for delicatessens, bakery stores, restaurants and the like, where it is desirable to be able to slice bread in varying thicknesses.

Conventional bread slicers are typically set up to slice loaves of bread to a specific thickness. Standard bread slice thickness is one-half inch, deli bread thickness is one-quarter to three-eighths inch, and garlic bread or French bread is up to one inch in thickness. In small bakeries where the bread is sold to customers directly, or other similar situations, it would be desirable to be able to adjust the slicer from one thickness to another quickly, even for successive loaves of bread for successive customers. However, known slicers require substantial disassembly and reassembly by a knowledgeable person over a period of 15 to 30 minutes, to change the slicing thickness. Indeed, some slicers are not subject to any variation at all.

There is a need in the market for a powered bread slicer which can slice one loaf to a particular slice thickness, e.g., one-half inch, readily slice the next loaf to another thickness, e.g., three-eighths inch, slice the third loaf to a third thickness, e.g., one inch or so, and so forth, without significant time delay or complexity.

SUMMARY OF THE INVENTION

This invention provides a power bread slicer capable of slicing successive loaves of bread to varying selected slice thicknesses, even by persons untrained in mechanical apparatus. The operator simply selects any of a multitude of potential thicknesses and activates the slicer. The bread loaf is advanced by a pusher, step-by-step, to be fed to a rotating or pivotally reciprocating cutting knife. Each step is of selected thickness. The knife may be a revolving circular knife which rotates through a slicing stroke and a return stroke, after each feed step, until the pusher is adjacent the knife, at which time the knife remains retracted while the pusher advances the cut loaf to a discharge position past the knife, and returns to the first side of the knife. The slicer works effectively on crusty breads such as garlic breads or French breads, as well as on soft, somewhat wet breads, such as conventional American bread.

These and other features, objects and advantages of the invention will become apparent upon studying the following detailed specification in conjunction with the drawings.

BRIEF DESCRIPTION OF THE DRAWINGS

FIG. 12 is a chart listing the definition of input devices;

DESCRIPTION OF THE PREFERRED EMBODIMENT

Figure 6:
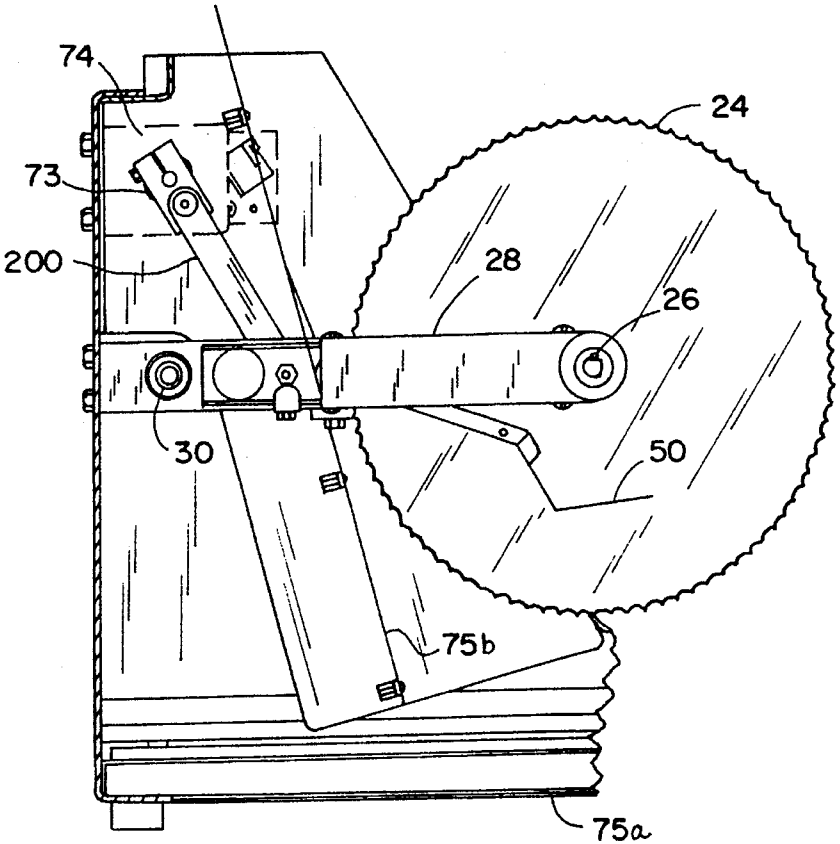
FIG. 6 is a sectional view of the bread slicer taken along the lines VI—VI in FIG. 5.

Referring now specifically to the drawings, the bread slicer assembly 10 includes a frame and housing subassembly 12 supporting the other functioning components. These other functioning components include a generally horizontal slide platform subassembly 14 of generally V-shaped configuration, to retain a loaf of bread, and made up of a V-shaped infeed table 16 and a V-shaped outfeed table 18 on opposite sides of a vertical plane containing a circular rotational slicer knife 24. This circular knife is rotationally mounted at its center at one upper end of a pivotal cutoff arm 28 (FIG. 6), by having a stub shaft 26 on the knife rotationally mounted on bearings in arm 28. This arm is pivotally mounted at its opposite lower end to a rotating shaft 30. An endless belt drive 34 extends around pulleys on stub shaft 26 and shaft 30 to form part of a drive connection. Another endless belt drive 38 extends around a pulley on shaft 30 and a pulley on the output shaft extending from drive motor 40. Motor 40 can be a conventional electric motor, e.g., one-half h.p., to rotationally drive the knife. The knife has scallops on its outer edge to slice bread, when operated to shift transversely to the platform, in the manner explained more fully hereinafter.

Figure 4:
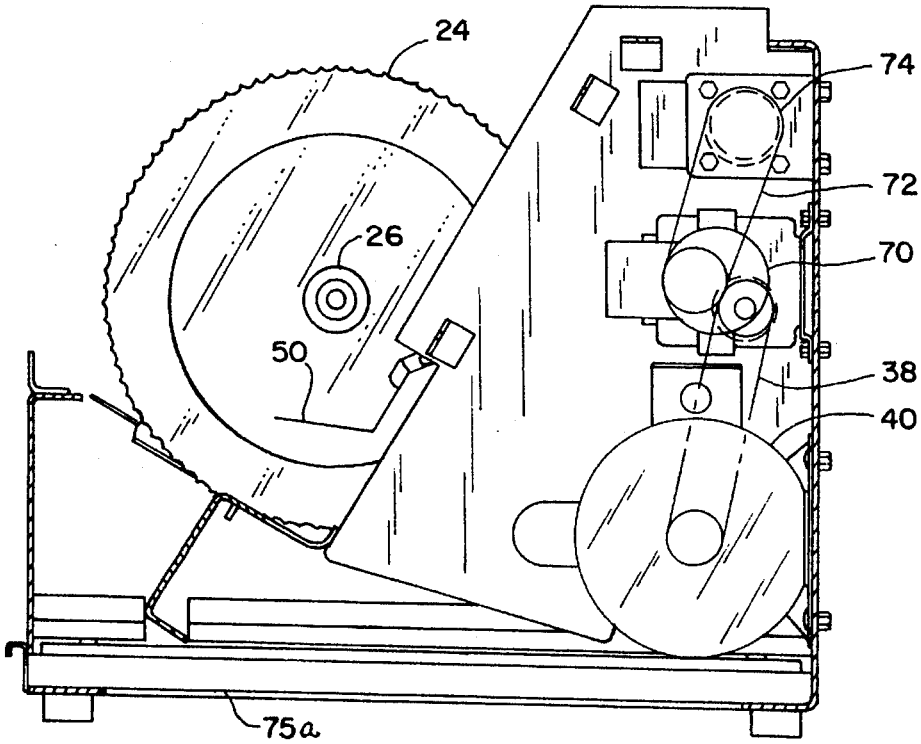
FIG. 4 is a sectional view of the bread slicer taken along the lines IV—IV in FIG. 3.

Cutoff arm 28 can pivot between an upper knife retracted condition, through an arcuate cutoff stroke ending at a lower position, with the knife edge below the slide subassembly and any bread thereon (FIG. 4).

Figure 1:
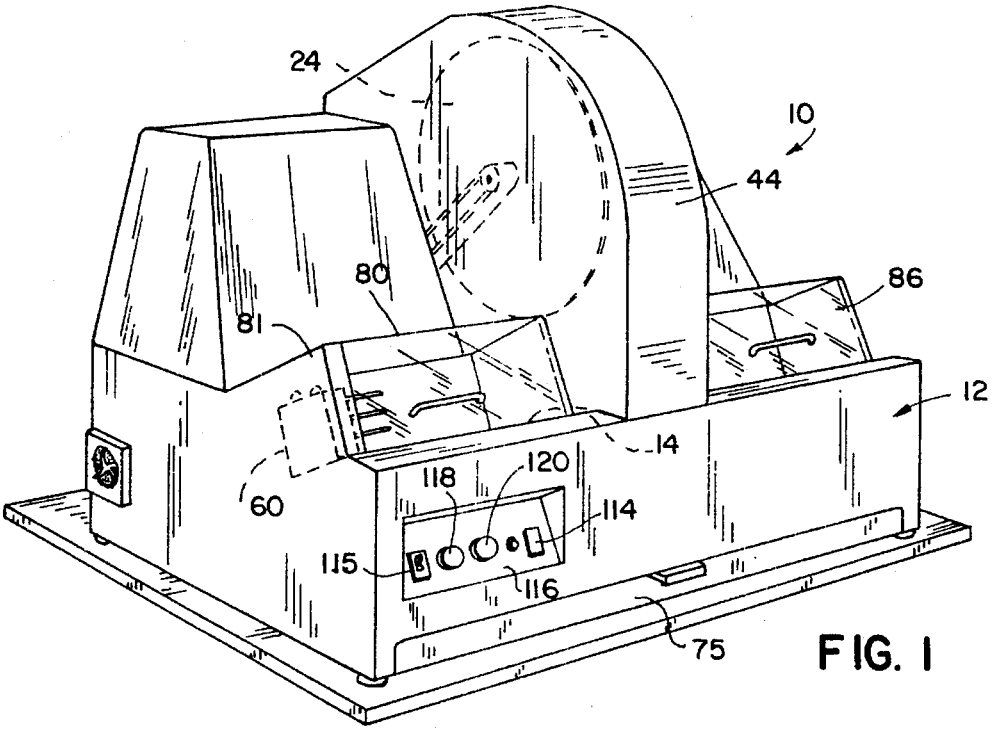
FIG. 1 is a perspective, front view of the novel bread slicer.
Figure 2:
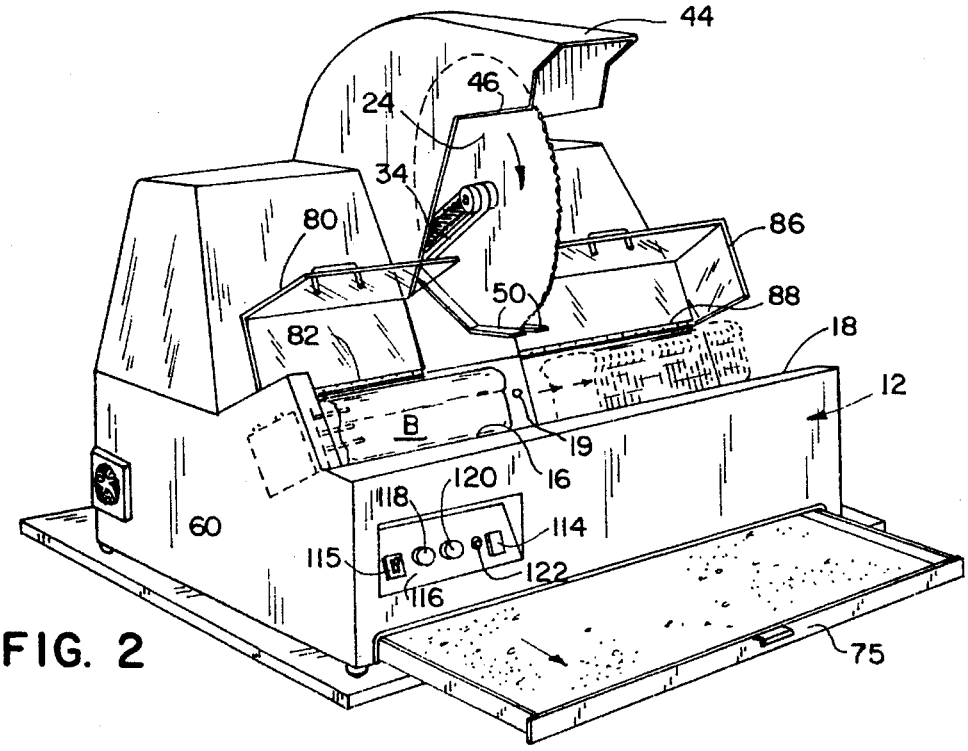
FIG. 2 is a perspective view comparable to FIG. 1, but with the protective covers raised.

A pivotal safety cover 44 for the knife is pivotally mounted to the housing at the upper rear edge of the cover, to move between a lower knife covering position (FIG. 1) and a raised knife revealing position (FIG. 2). In the lower knife covering position, an inverted, V-shaped opening in the side walls of the cover, on each side of the knife, enables passage of a loaf of bread B through cover 44 to be operated upon by knife 24. Astraddle knife 24 is a pair of downwardly biased, bread hold down fingers 50 (FIG. 2) to prevent the bread from rising with the raising of, i.e., retraction of, knife 24 after a cut is made.

Figure 3:
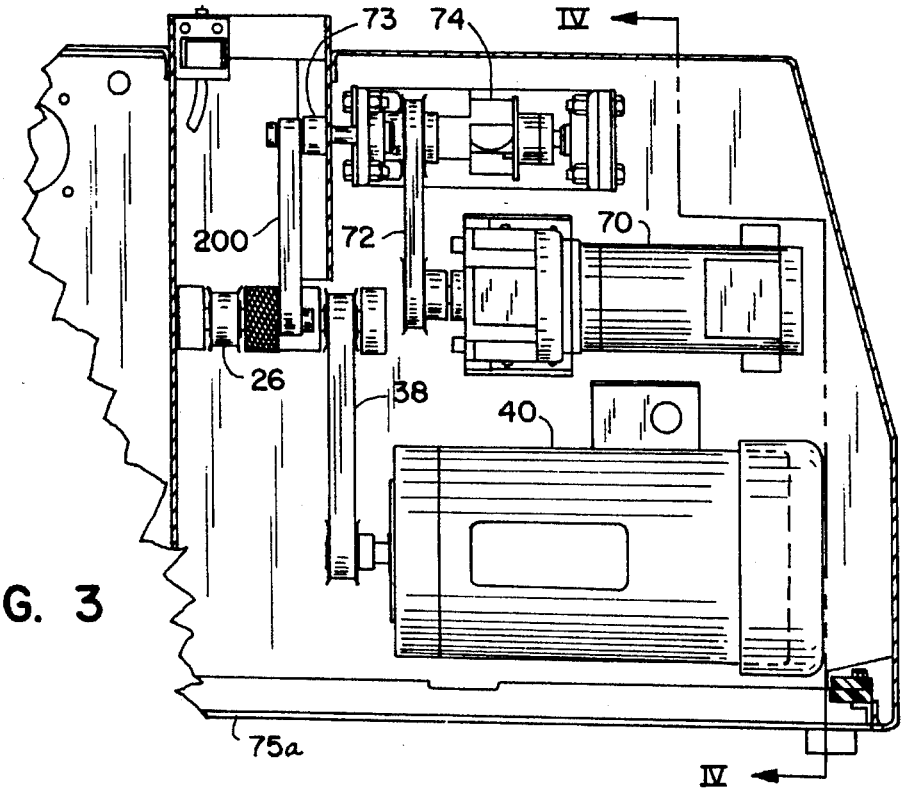
FIG. 3 is a front, elevational, cutaway view showing operative mechanical components of the slicer.
Figure 5:
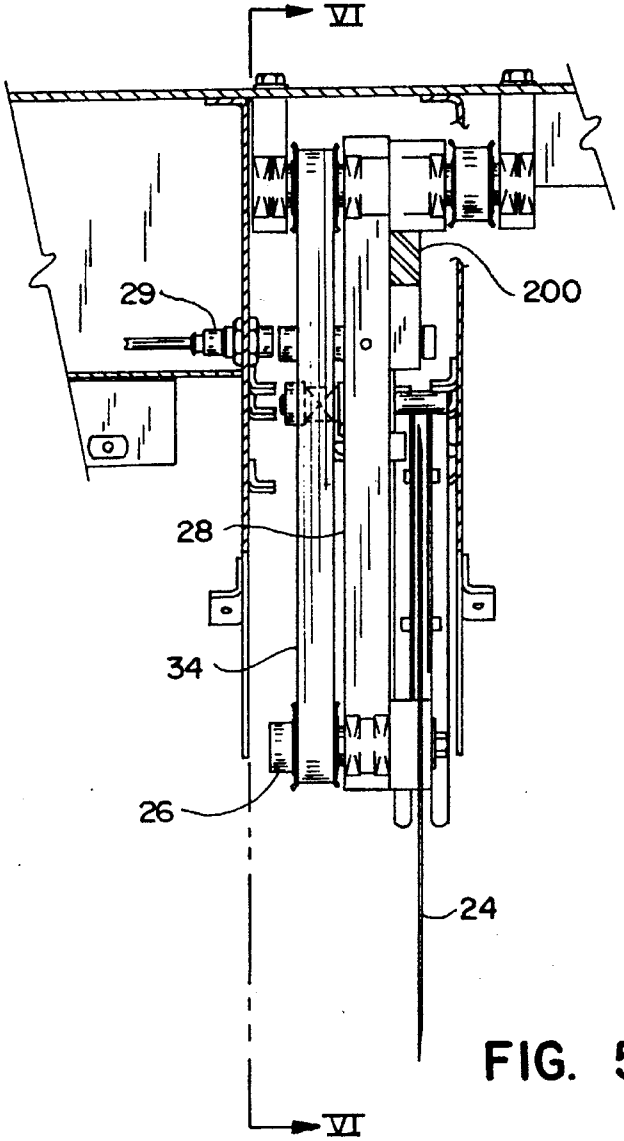
FIG. 5 is a top, elevational, cutaway view showing operative mechanical components of the slicer.

Cutoff arm 28 is reciprocably operated by cutoff drive motor 70 (FIG. 3) through a belt drive 72, a conventional single revolution cutoff clutch 74 and a crank arm 73, connecting rod 200 to pivot arm 28 from its upward position, through an arc, to its full downward position and back to its upward position where it engages the cutoff arm return proximity switch 29 (FIG. 5) to be arrested, awaiting reactivation.

Pivotally mounted adjacent to, and extending over, infeed table 16 is a three dimensional, open bottom, horizontally elongated cover 80 mounted at its upper rear edge on pivot hinge 82 to housing 12. It pivots between an upper position uncovering infeed table 16 to a lowered position covering table 16 and a loaf of bread B thereon. A bread pusher assembly 60 is covered by a stationary cover 81 when in a retracted position at the outer end of the bread loaf (FIG. 1). Cover 80 has an open discharge end adjacent opening 46 in cover 44 to allow bread to be advanced to the knife. This cover 80 is preferably transparent, as of polycarbonate, to enable viewing of the bread B. A second open bottom cover 86 is pivotally mounted at its upper rear edge on hinge 88 to housing 12, to pivot between an upper condition (FIG. 2) uncovering outfeed table 18, and a lowered position (FIG. 1). It has an open bread receiving end adjacent opening 46 in cover 44 to receive and cover the bread B after it is sliced.

There are three safety lockout switches actuated by the three respective covers, namely switch 90 for cover 80, switch 94 for blade cover 44, and switch 92 for cover 86, to prevent knife 24 from operating and cutoff arm 28 from lowering if any of the three covers is raised.

Figure 7:
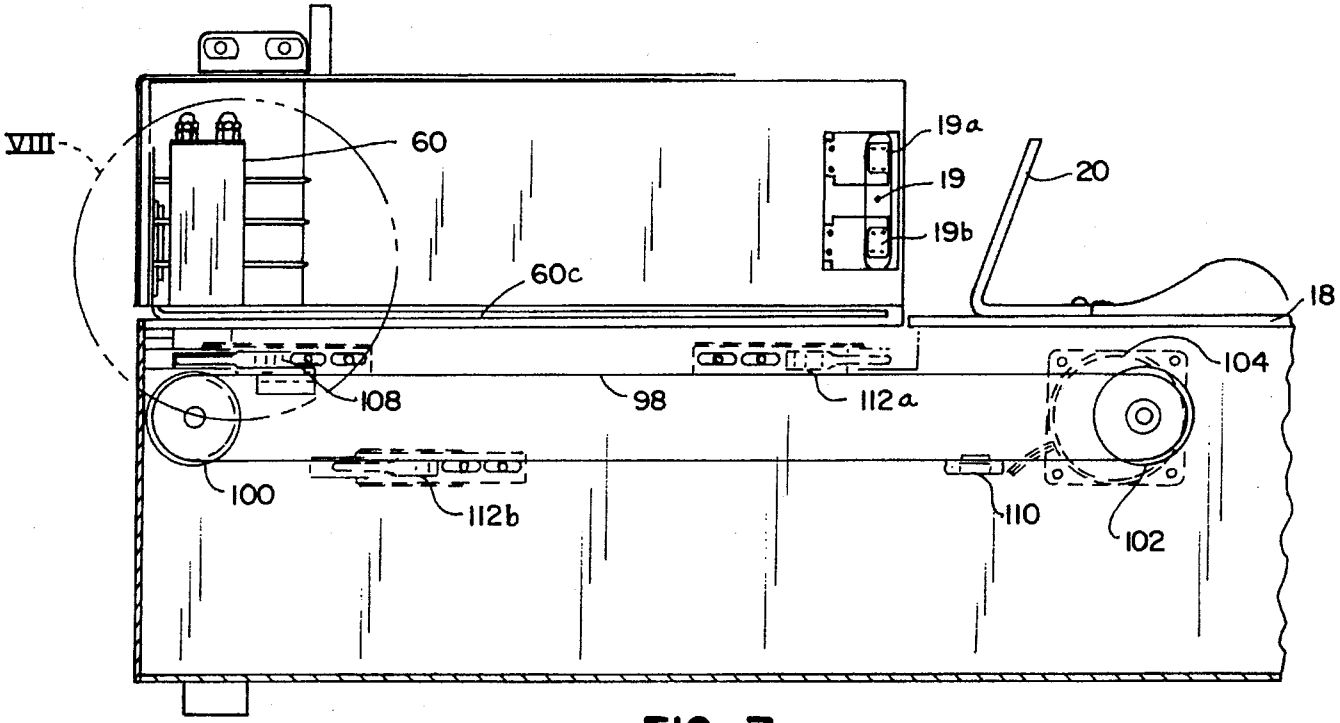
FIG. 7 is a front elevational, somewhat schematic view of the bread advancing mechanism.

Extending above the slide platform 14 is a pusher assembly 60 including a vertical pusher plate 60*a* and a fork assembly 60*b*. Pusher assembly 60 is capable of moving from an initial position at one end, here the left end of the infeed table and slide platform, spaced from knife 24 more than the length of a loaf of bread B, toward the knife and ultimately to a final position just on the opposite side of knife 24, i.e., at the outfeed table, as shown by the phantom lines in FIG. 2. A heel holder plate 20, which is mounted for reciprocal travel over outfeed table 18 (FIG. 7), maintains the slices together on the outfeed table.

Pusher assembly 60 is connected by a hitch 61 to underlying belt 98 (FIGS. 7, 8*a* and 8*b*) to be above platform 14, and particularly above infeed table 16 and outfeed table 18. It is mounted on endless belt drive 98 (FIG. 7), to be advanced toward and just beyond knife 24, as described hereinafter. Endless member 98 extends around a first pulley 100 beneath the outer end of infeed table 16, and a second pulley 102 beneath outfeed table 18. Endless drive member 98 is driven forwardly toward knife 24 in preselected increments by a variable step, incremental, stepper motor 104 (FIGS. 7 and 9*a*–9*c*) of conventional type, e.g., 200 steps per revolution. It operates a gear box which drives pulley 102. The retracted position of pusher assembly 60 is controlled by a limit switch serving as an end-of-travel switch 108 which is engaged by hitch 61 mounted on drive member 98. The furthermost advanced position of pusher 60 is controlled by two limit switches, switch 112A near the knife, and switch 112B below drive member 98, near pulley 100. Switch 112A is actuated by hitch 61, and switch 112B is actuated by actuator 110, either switch, if actuated, causing the arm 28 to be retained in the retracted position. After final retraction of the arm, the pusher assembly moves just past the knife for fully shifting the complete loaf of bread onto the outfeed table. When the outfeed table cover 86 is lifted for removal of the bread, and then closed again, pusher assembly 60 returns to the infeed table. In brief, the initial position of pusher assembly 60 is at the outer (left) end of infeed table 16 while the furthermost position of pusher assembly 60 is just beyond knife 24 above outfeed table 18.

Figure 8B:
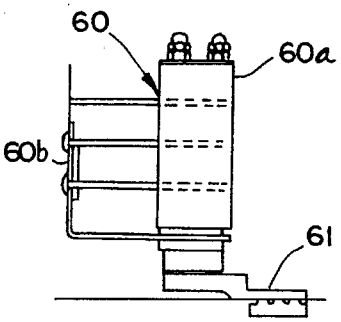
FIGS. 8*a* and 8*b* are clarifications of the area indicated by VIII in FIG. 7 in different portions of a slicing cycle.
Figure 8A:
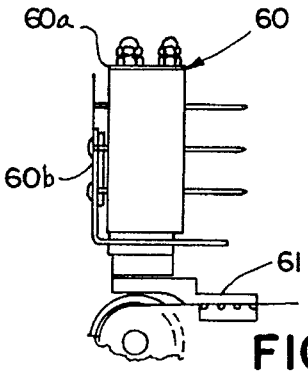
Figure 9:
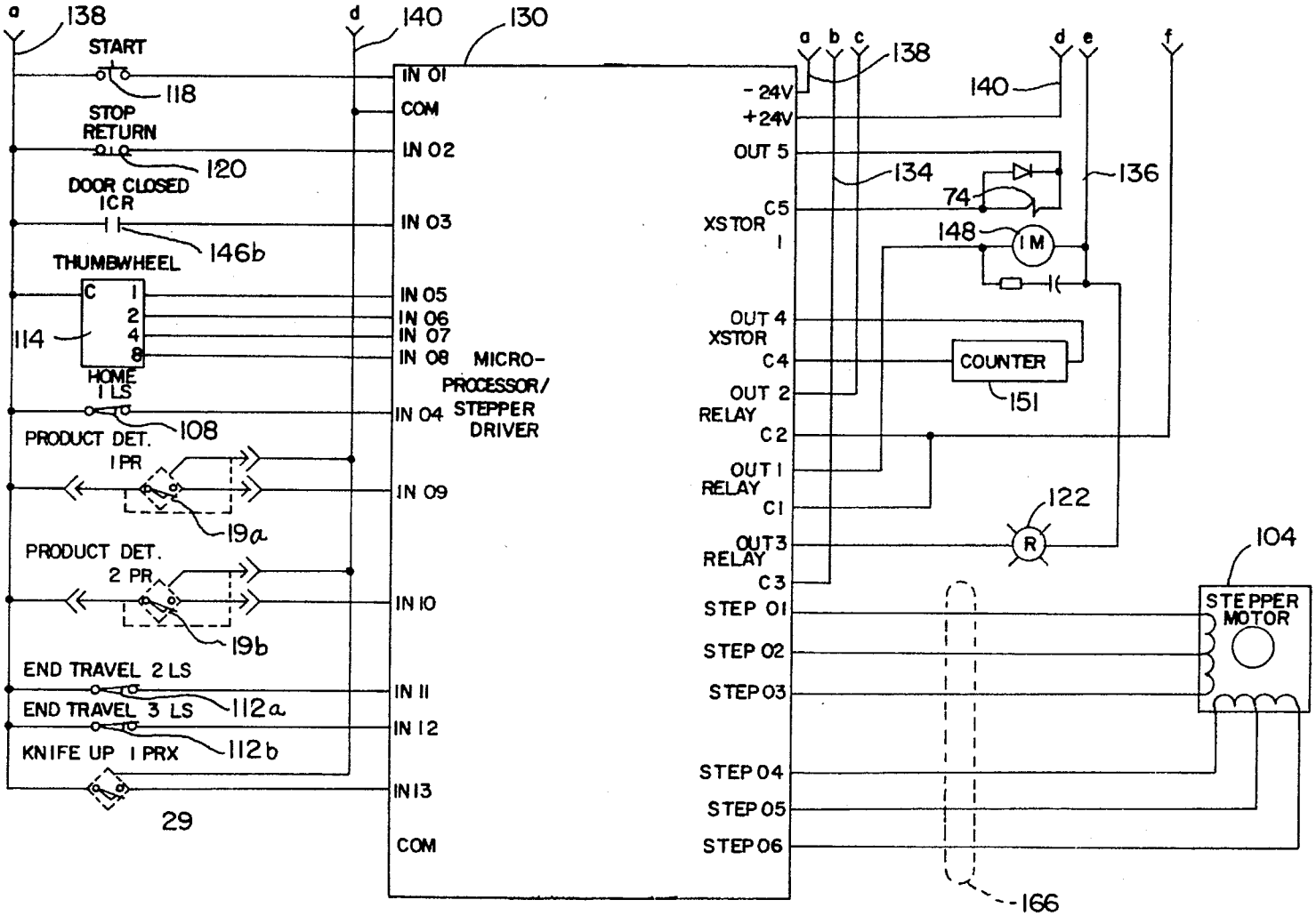
FIGS. 9 and 9*a* are a circuit diagram for the apparatus.
Figure 9A:
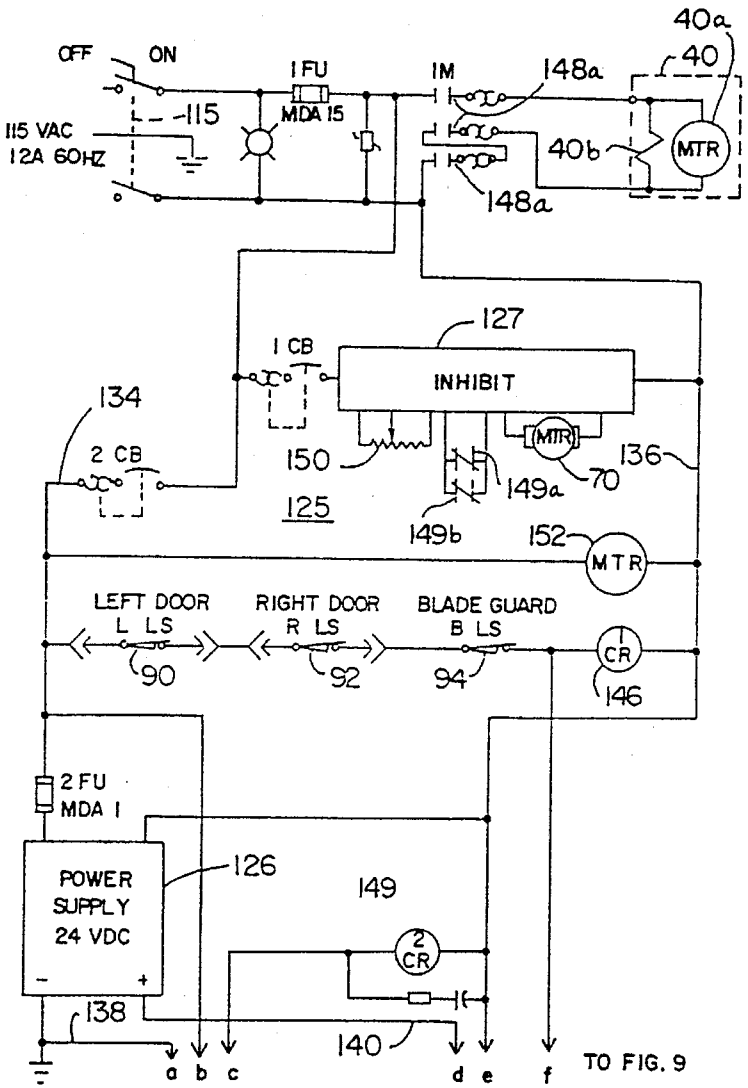

Only pusher plate 60*a* is directly coupled with hitch 61. Fork assembly 60*b* travels in a channel 60*c* (FIG. 7) and is frictionally engaged with openings in pusher plate 60*a*. Fork assembly 60*b* is arrested in motion at the end of channel 60*c* adjacent to knife 24 prior to reaching the knife, as illustrated in FIG. 8*b*. This allows the tines of fork assembly 60*b* to penetrate deeper into a loaf of bread than a typical slice thickness yet avoid contact with the knife. The fork assembly tines are reinserted in the openings of pusher plate 60*a*, as pusher plate 60*a* is retracted to the infeed table, as illustrated in FIG. 8*a*.

An elongated lower crumb tray 75*a* for collecting dropping crumbs is extendible from a first position inside housing 12 (FIG. 1) beneath the slide platform, to a removed condition from the housing for dumping (FIG. 2 shows partial removal). A generally vertically extending crumb chute 75*b* guides crumbs into crumb tray 75*a*.

At the infeed table, immediately before and adjacent knife 24, are two photoelectric sensors 19 (FIG. 2) to detect the presence of the leading end of a loaf of bread ready to be sliced. If covers 80, 44 and 86 are closed, this sensor can activate slicer drive motor 40A and cutoff arm drive 70, 72, 74. A resilient wiper (not shown) mounted toward the rear of pusher plate 60*a* wipes crumbs from the Plexiglas covering sensors 19.

Stepper motor 104 is controllable in conventional fashion using a stepper motor driver, and preferably through a microprocessor control 125, to allow it to take a predetermined number of the 200 or so incremental steps possible per revolution. This enables manual presetting of the dimension of each advancing step sequentially taken by the motor, so as to set the dimensional distance that pusher 60 moves in each increment. This manual setting is readily performed by the human operator by rotating an exposed arcuate surface portion 114 (FIG. 2) of a conventional thumb wheel, for example, to a "½" inch designation indicia thereon, e.g., for the one-half inch unit, or to another increment dimension desired, for the thickness of the bread slice. The thumb wheel is exposed at 114 on control panel 116 which also includes an on-off switch 115, start button 118, stop button 120 and indicator light 122. Suitable control circuitry may be that set forth in FIGS. 9*a*–9*c* and 10*a*–10*b*, or the equivalent.

Referring now to FIGS. 9*a*–10*b*, a control 125 is shown connecting AC voltage across lines 134 and 136 whenever on-off switch 115 is placed in the ON position. A control relay 146 is energized whenever switches 90, 92 and 94 are closed, indicating that the covers 80 and 86 for the infeed and outfeed tables, as well as the safety cover 44 for the knife, are closed. Also, with switches 90, 92 and 94 closed, power is fed to the output contacts C1 and C2 of the microprocessor to energize a relay 148 provided that an output designated OUT 1 of a microprocessor and stepper driver 130 provides a suitable output command, to thereby apply power to knife drive motor 40A, and knife motor brake 40B through relay contact 148*a*. An output designated OUT 2 of microprocessor/stepper driver 130 supplies power to a relay 149 which opens contacts 149A and 149B, which removes the drive inhibit of DC driver control 127. DC driver control 127 supplies an adjustable DC voltage level to cutoff arm drive motor 70. A variable potentiometer 150 provides adjustable control of the speed of motor 70 in order to allow regulation of the speed at which the arm is moved through the bread. A cooling fan motor 152 is energized whenever switch 115 is in the ON position in order to supply cooling air to control 125. Indicator 122 provides a red warning indication whenever microprocessor/stepper driver 130 determines that a cover is not properly closed.

Microprocessor/stepper driver 130 receiving inputs from start switch 118, stop/return switch 120, a contact **146*b* of relay 146, thumb wheel switch 114, retracted-position limit switch 108, redundant photoelectric bread sensors 19*a*, 19*b*, redundant end of travel limit switches 112*a*, 112*b* and cutoff arm return proximity switch 29 (FIG. 9*b*). Such input devices receive supply voltage from input DC supply lines 140 and 138. Microprocessor/stepper driver 130 receives supply voltage from DC power supply 126 via supply lines 138 and 140. Microprocessor/stepper driver 130 provides an output OUT 5 to single revolution cutoff clutch solenoid 74 and an output OUT 4 to counter 151. Output 151 is a 6-digit, manually reset counter which counts entire cycles of the apparatus. Microprocessor/stepper driver 130 produces step outputs (01–06) 166 that are capable of driving stepper motor 104**.

Figure 11:
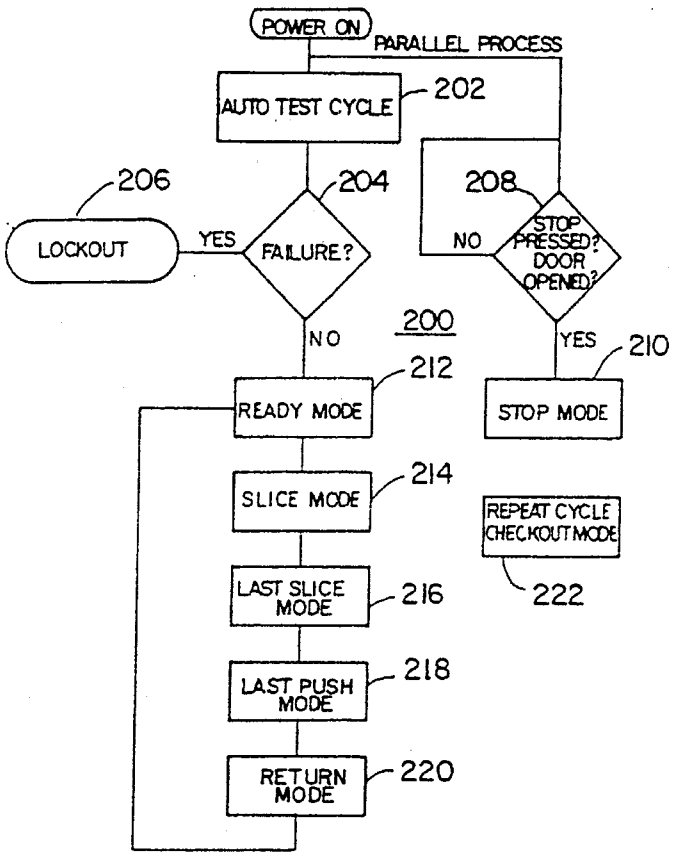
FIG. 11 is a flow chart of a control routine for the apparatus.

Microprocessor/stepper driver 130 responds to the state of the inputs being provided to it and produces outputs to relays 148 and 149, to single revolution cutoff clutch solenoid 74 and to stepper motor 104. A control program 200 (FIG. 11) establishes the number of steps that stepper motor 104 is to be incremented. Hence, the data inputs of thumb wheel switch 114 determine the distance that belt 98 will be incremented, and hence the thickness of each bread slice.

Operation of control program 200, with covers 44, 80 and 86 being closed, i.e., lowered, is started by the on-off switch 115 being actuated, applying power at 201 to the equipment. The microprocessor/stepper driver 130 then initiates a self check sequence at 202. During the self check sequence, the position of the pusher plate **60*a* is first checked to see whether it is in the outer extreme position. If the pusher plate is not in the correct position, the microprocessor/stepper driver 130 will retract the pusher plate until it is in the extreme outer position. Then the pusher assembly is advanced to the end limit switches 112*a* and 112*b*. After actuating both limit switches in sequence, the pusher is then retracted back to the extreme outer position, ready for operation. If, during the self check, it is determined at 204 that either end limit switch 112*a* or 112*b* fails to operate, the microprocessor/stepper driver will enter a lockout mode 206** in which operation is stopped, and the operator is alerted to a malfunction. The equipment must be turned off to reset the microprocessor/stepper driver in order to exit the lockout mode.

Self check sequence 202 cannot be bypassed. By leaving any of the covers 44, 80, 86 open when turning on the machine, which is determined at 208 and places the control in a stop mode 210, the self check sequence can be also interrupted during its cycle by pushing the stop button 120. Once the microprocessor/stepper driver is in stop mode 210, only by closing the doors and pressing the start button will the microprocessor finish its self check sequence.

Once it is determined at 204 that there were no failures during the self check mode, the apparatus is in a ready mode 212. During this mode, a loaf of unsliced bread is placed on slide platform 14, and specifically on infeed table 16, while cover 80 is raised. The outer end of the loaf is abutted against pusher plate 60, which is at its outer extreme position, with the tines of fork assembly **60*b* engaging the loaf. The thumb wheel 114 is set to the desired cut size and the cover 80 is then lowered, as well as cover 44 and cover 86 being closed, i.e., lowered. The equipment may then be actuated by pushing start button 118. Knife 24 is at this time in the retracted elevated condition, i.e., not the cutoff condition. Pusher assembly 60 advances bread B toward knife 24 until the product detection scanner 19 detects the leading edge of the loaf of bread. At this point, the stepper motor will stop, with the leading edge of the loaf being just in front of knife 24. At this time, the apparatus enters a slice mode 214. In the slice mode, the knife drive motor 40a and slicer arm drive 127 and 70 are powered up, and the knife brake 40*b* energized, releasing the knife. Once the slicer motor comes up to speed, the stepper motor 104 will index one unit width forward, the unit width dimension having been determined by the previous setting on the thumb wheel 114**.

The slicer arm will then actuate to lower the knife to cut the first slice, and this intermittent incremental sequence will continue until the end limit switch 112 for pusher 60 is actuated. When end limit switch 112 is actuated, the control enters a last slice mode 216 in which it is determined whether the last slice of bread is of a suitable thickness to be sliced again into two slices. Microprocessor/stepper driver 130 counts the number of pulses between the initiating of the last indexing of belt 98 and the actuation of limit switch 112. This count is converted into belt travel and, hence, thickness of the last bread slice. If the determined thickness of the last bread slice is more than 80 percent greater than the thickness entered by the operator using thumb wheel switch 114, then single revolution cutoff clutch 74 is again actuated to make one additional slice.

At this point, a last push mode 218 is entered. The arm and knife drive turn off, and the brake solenoid 40B de-energizes, stopping the bread knife rotation. Then pusher 60 will advance past knife 24 to push the remainder of the loaf onto the outfeed table beneath cover 86. The operator will then lift cover 86 and remove the sliced bread. The operator can now return the heel holder 20 to its position closer to knife 24. Reclosing of door 86 will initiate a return mode 220 and enable pusher 60 to return to its initial retracted position (FIG. 2) for receipt of the next loaf of bread in front of it. At any point, operation of the apparatus can be interrupted by pressing stop button switch 120. Further, opening any of the three covers at any time will deactuate power to the knife drive. A flow chart illustrating the detailed operation of control program 200 is appended to this specification as Appendix A and is intended to form an integral portion of the specification.

Figure 10A:
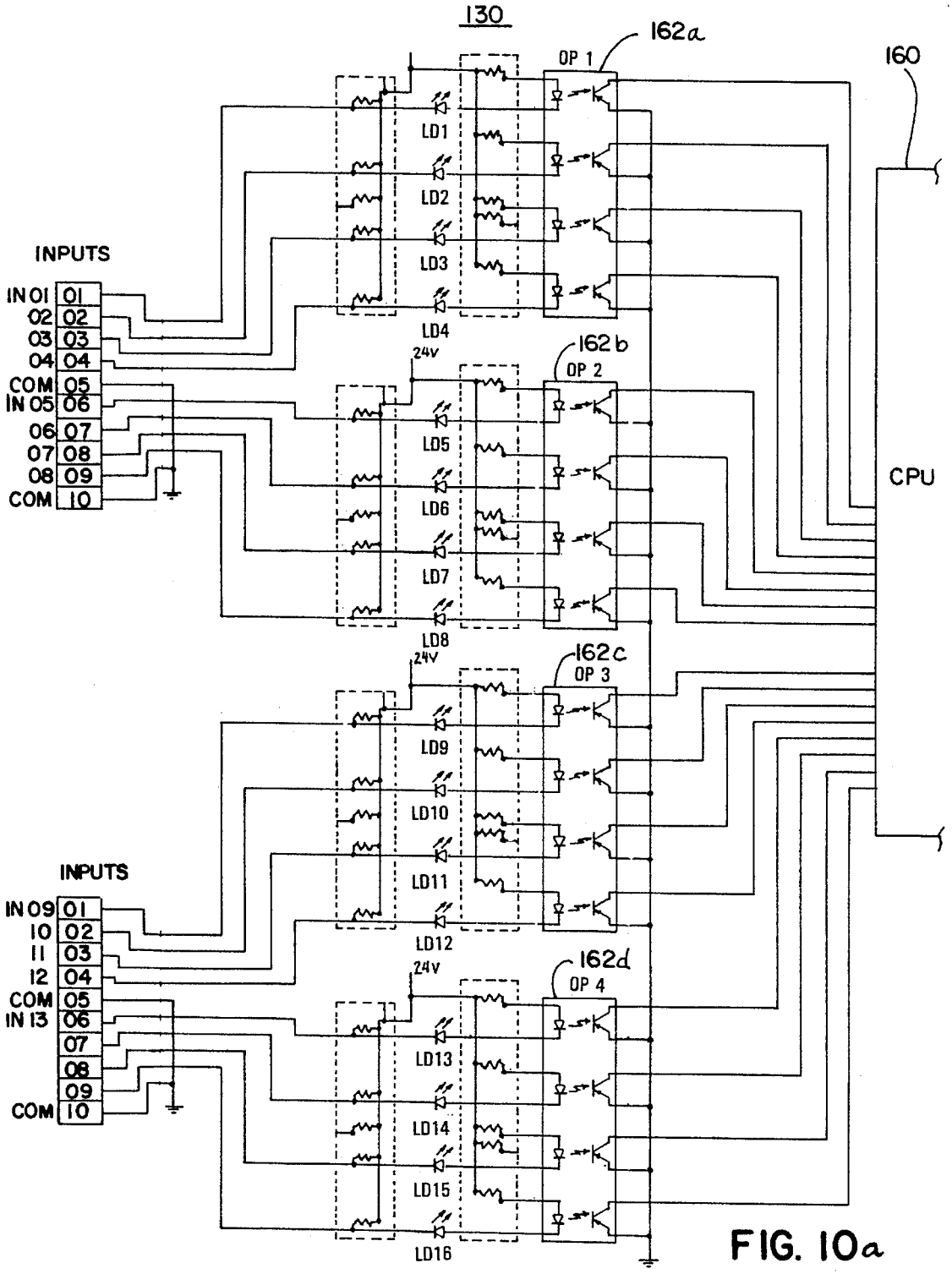
FIGS. 10*a* and 10*b* are a circuit diagram for the microprocessor/stepper driver assembly.
Figure 10B:
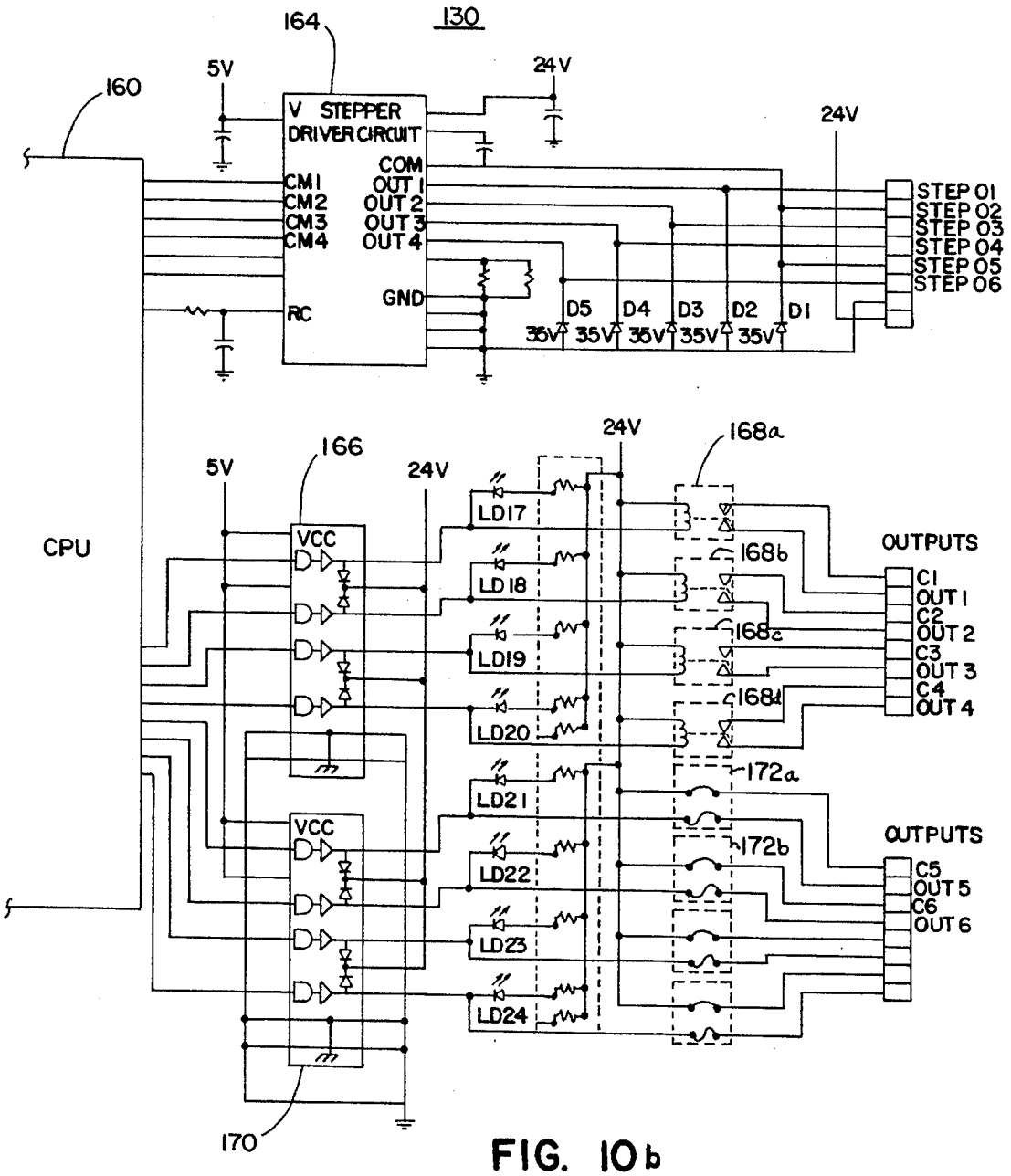
Figure 13:
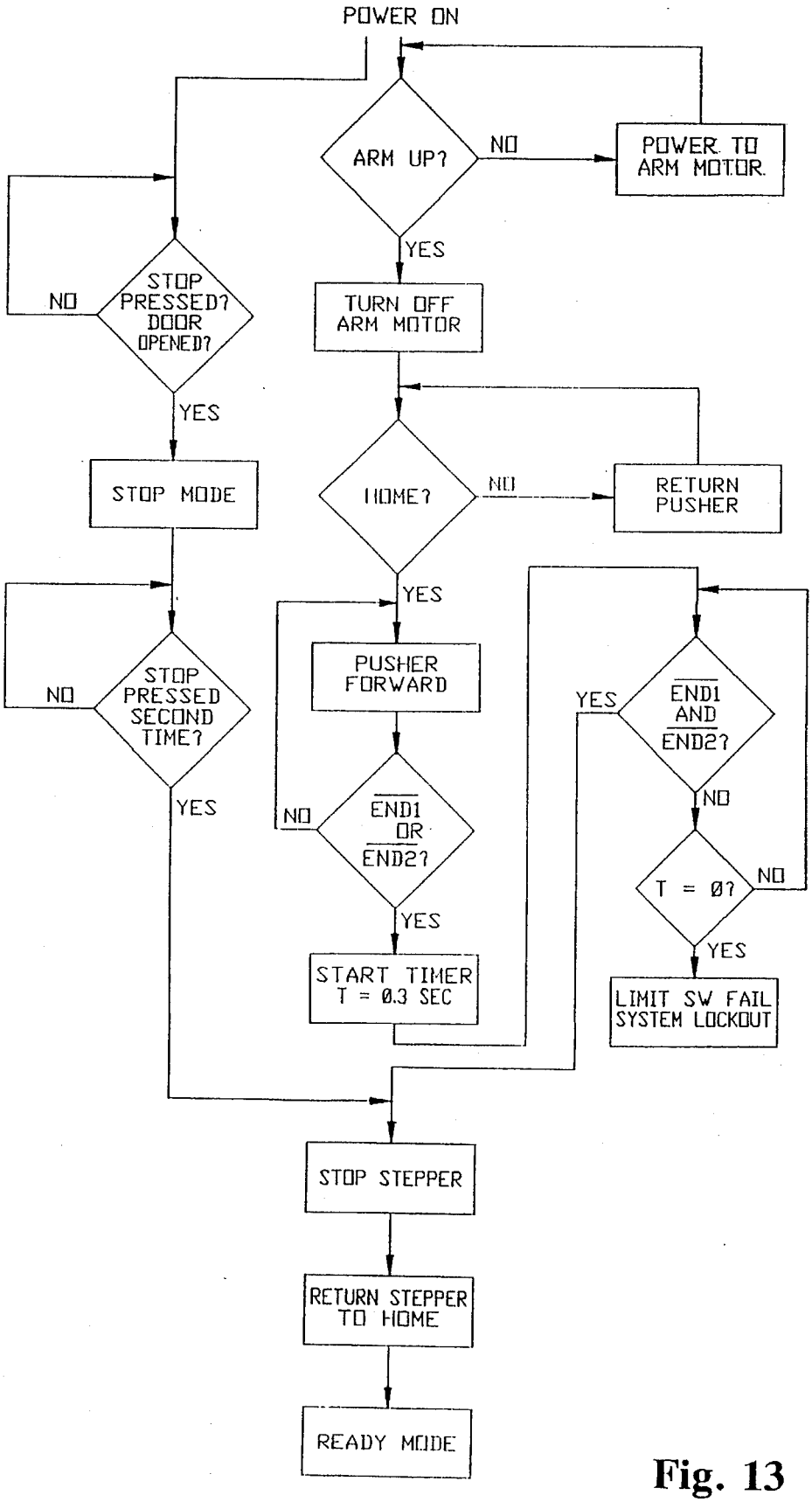
FIG. 13 is a flowchart of an auto test cycle routine for the apparatus.
Figure 14:
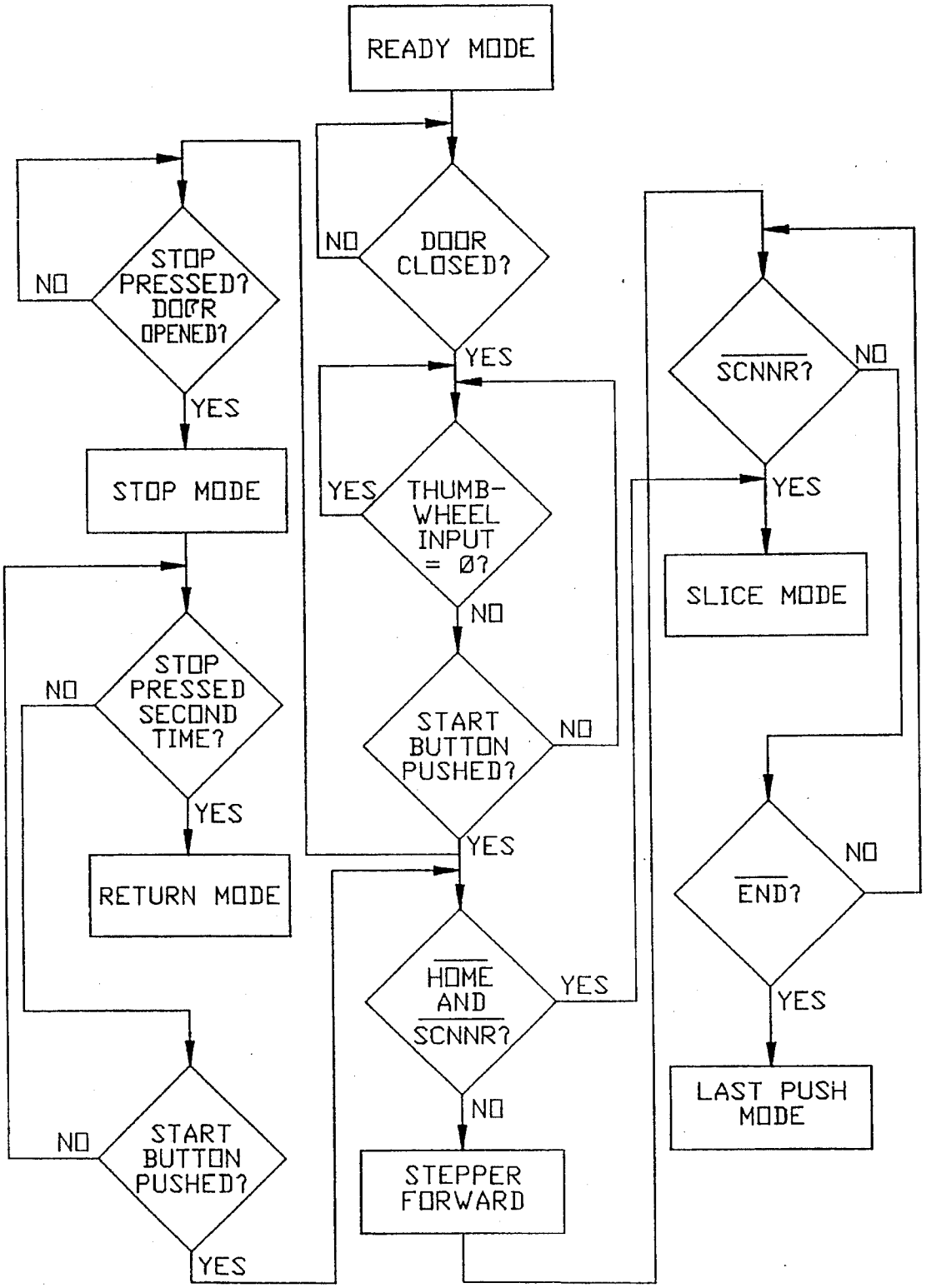
FIG. 14 is a flowchart of a ready/forward control routine for the apparatus.
Figure 15A:
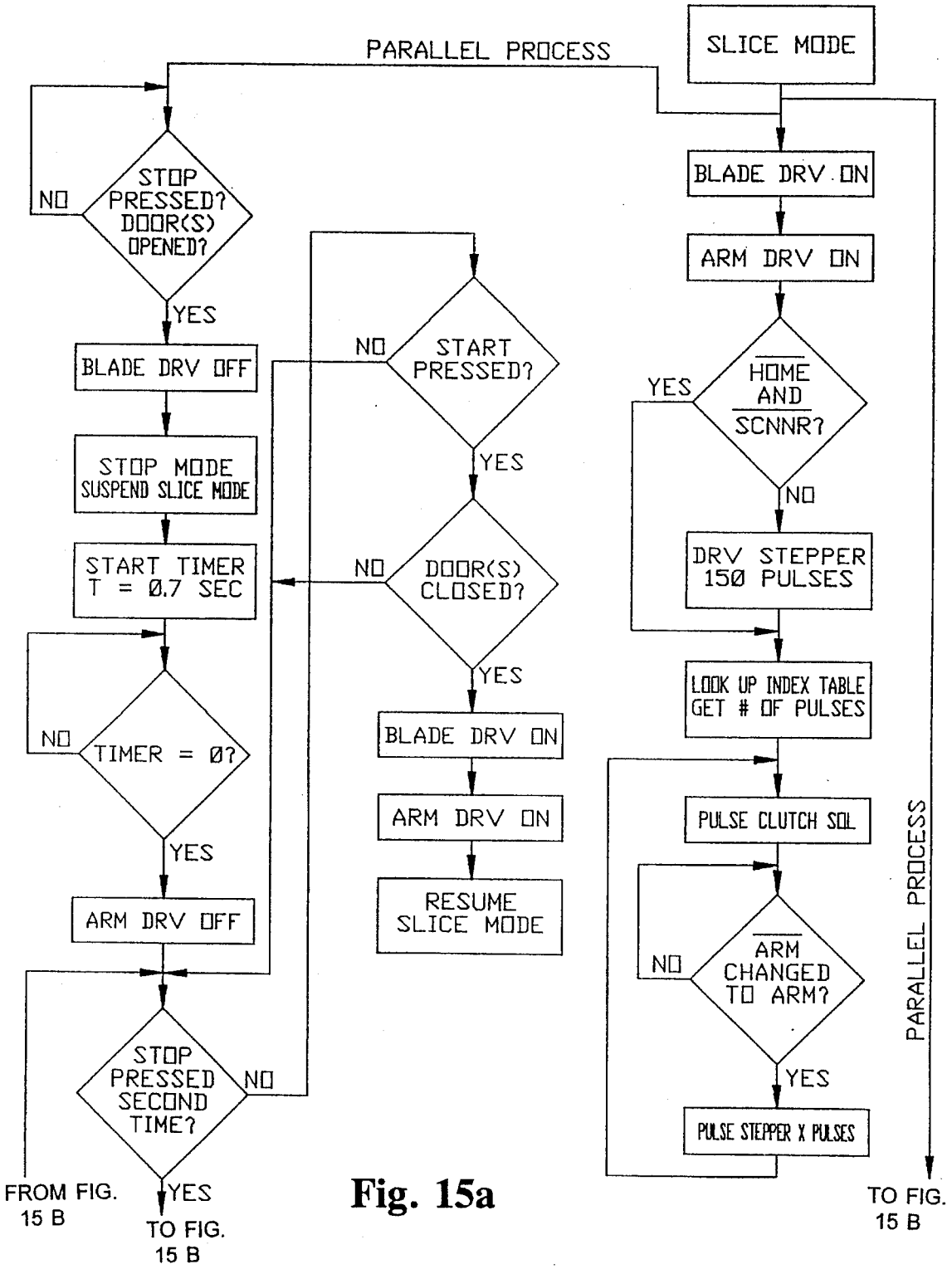
FIGS. 15*a* and 15*b* are a flowchart of a slicing control routine for the apparatus.
Figure 15B:
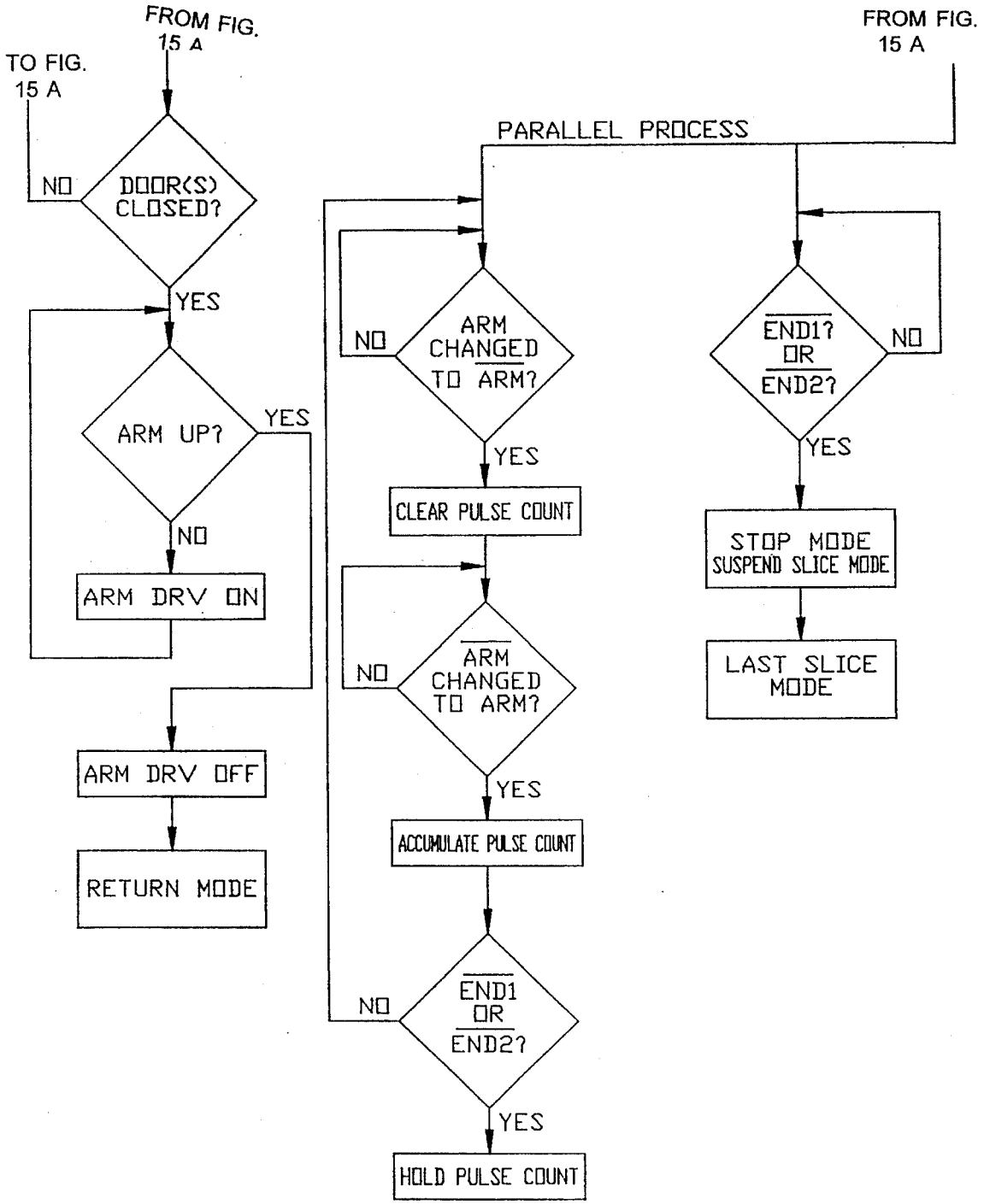
Figure 16:
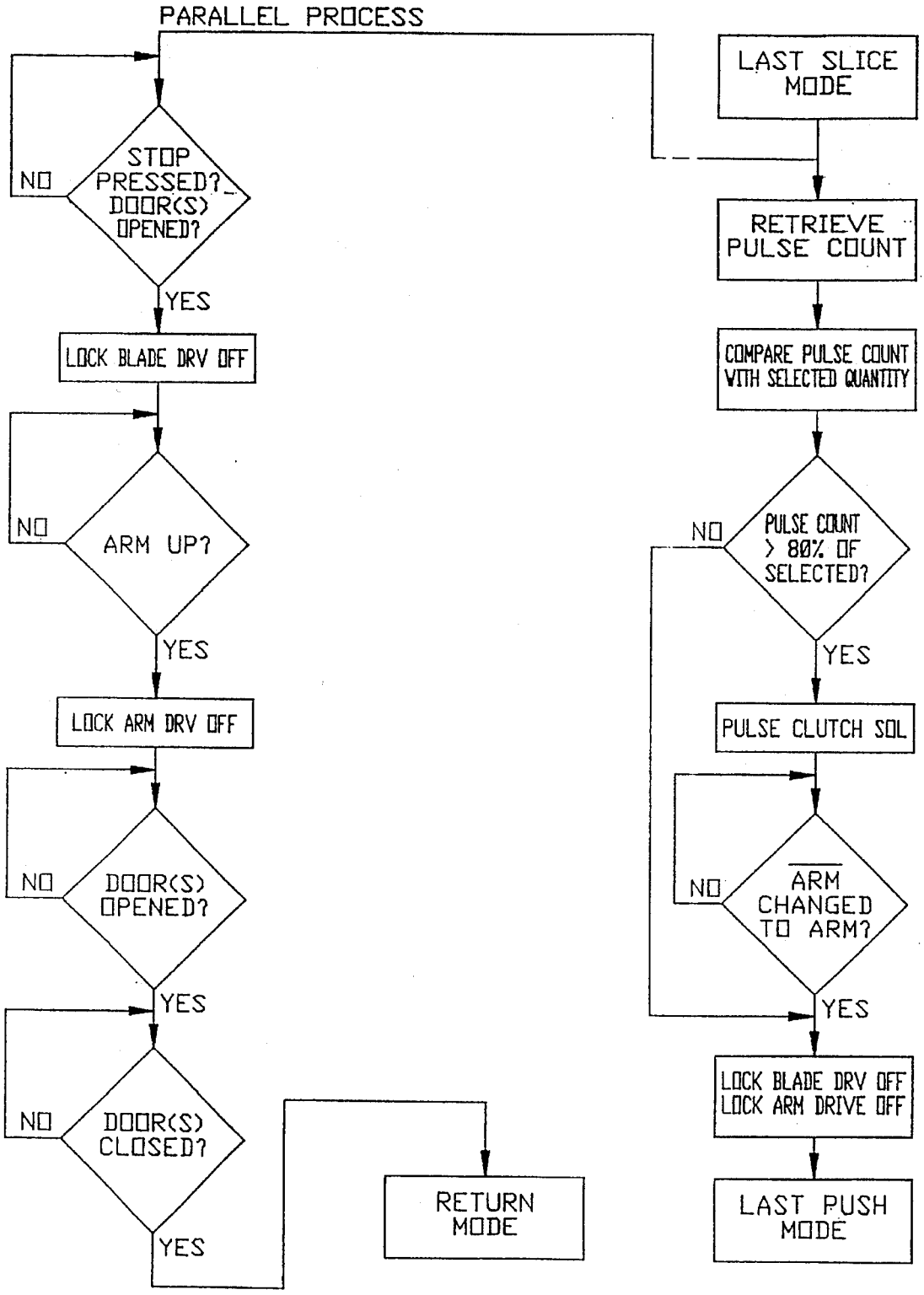
FIG. 16 is a flowchart of a last slice check routine for the apparatus.
Figure 17:
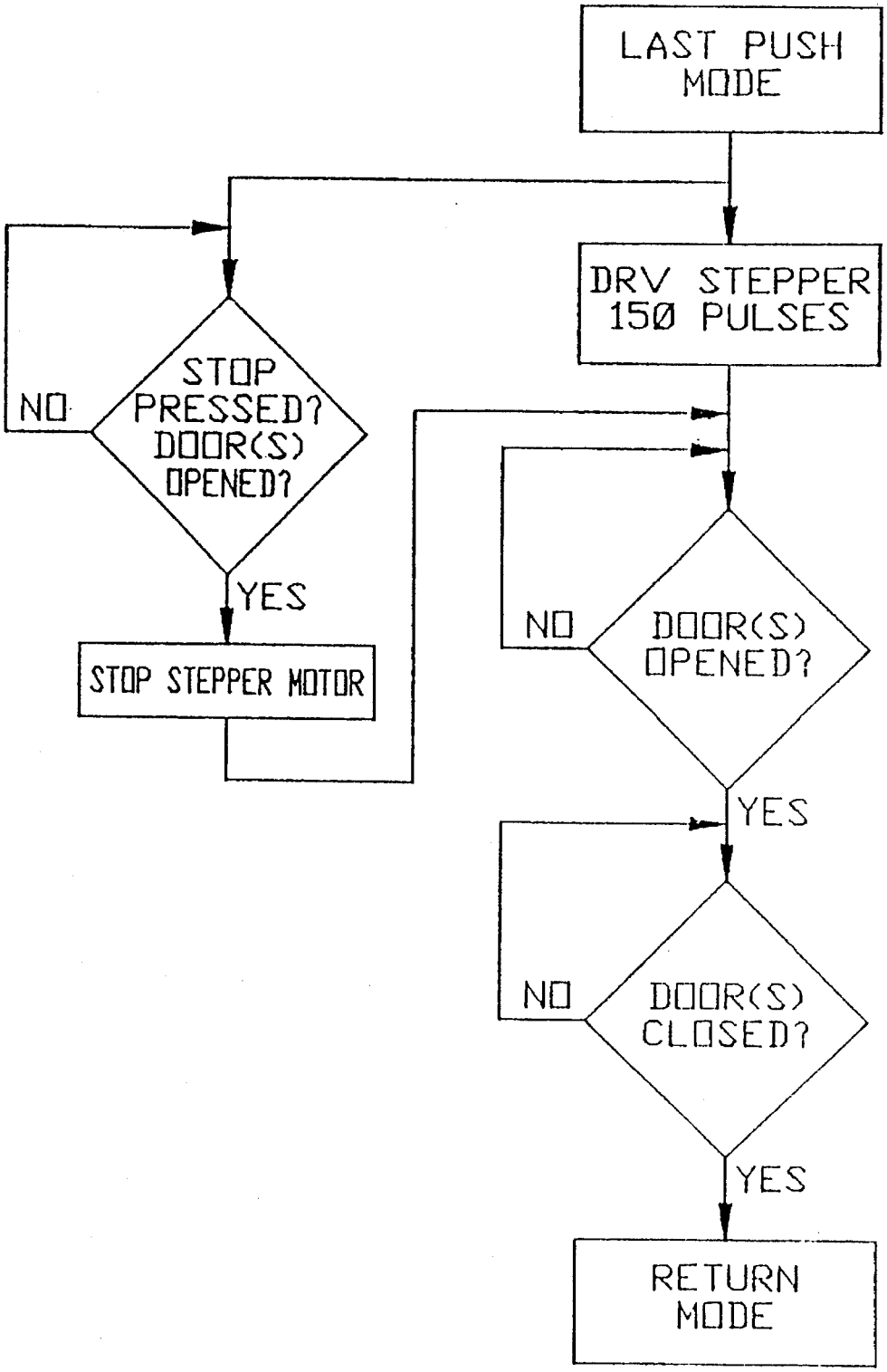
FIG. 17 is a flowchart of a last push control routine for the apparatus.
Figure 18:
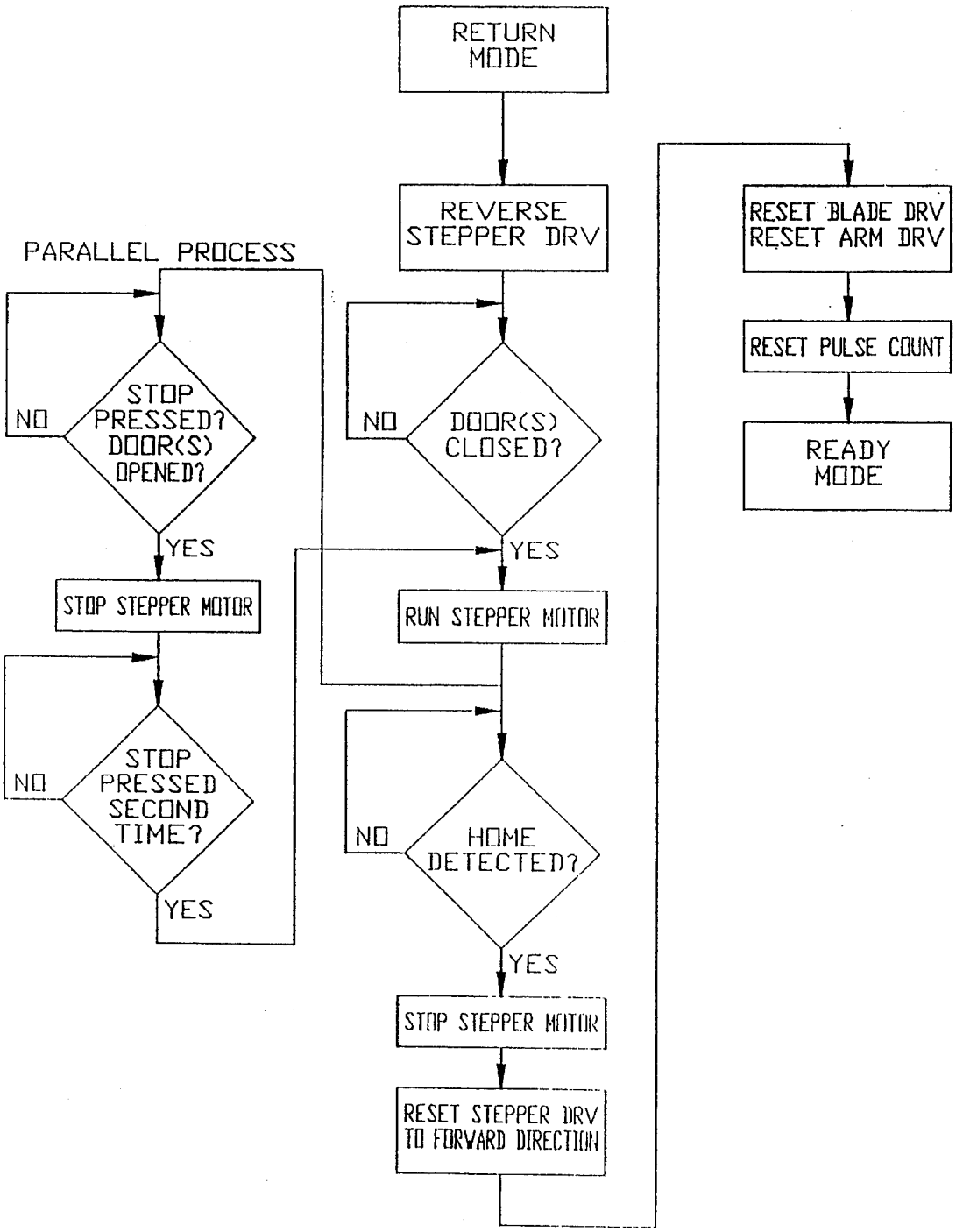
FIG. 18 is a flowchart of a return pusher control routine for the apparatus.
Figure 19A:
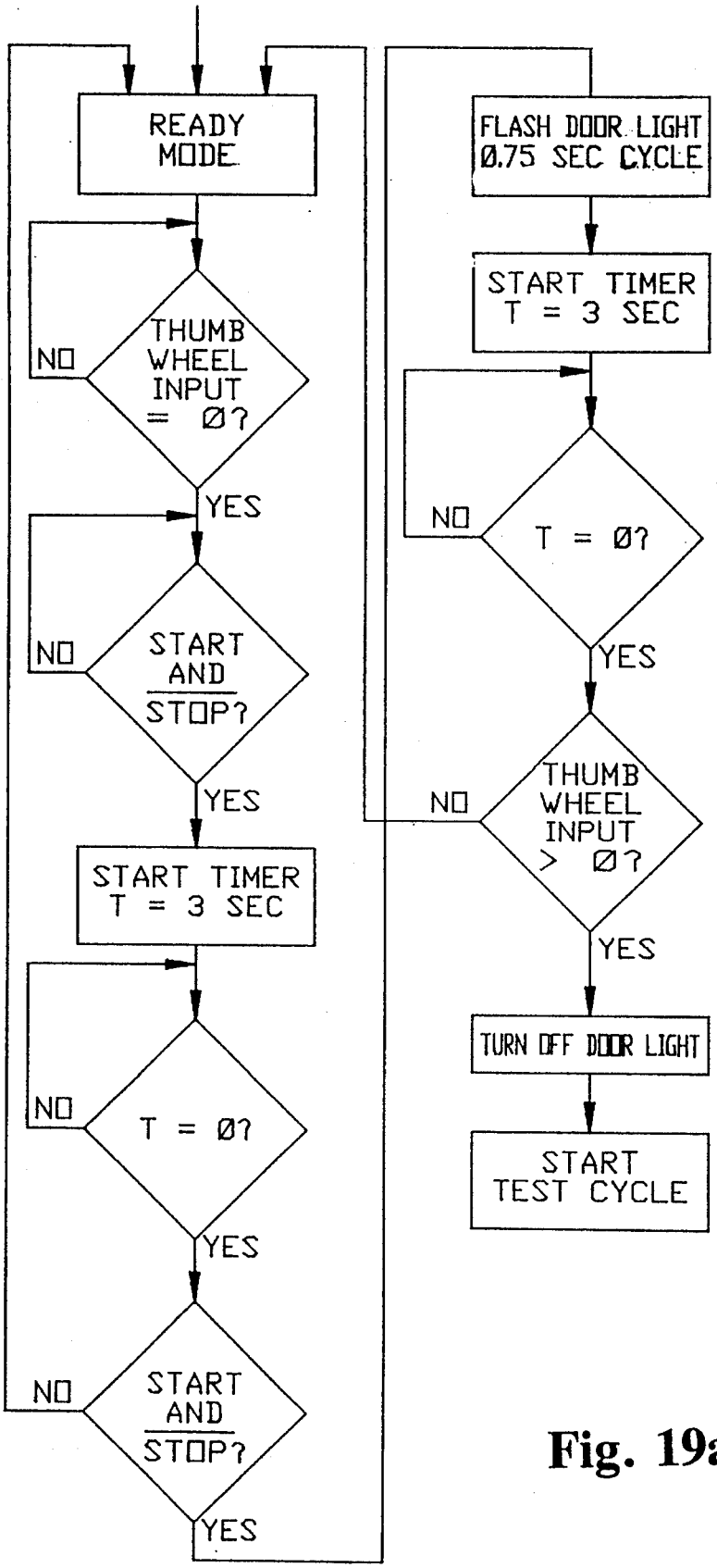
FIGS. 19*a* and 19*b* are a flowchart of a repeat cycle checkout routine for the apparatus.
Figure 19B:
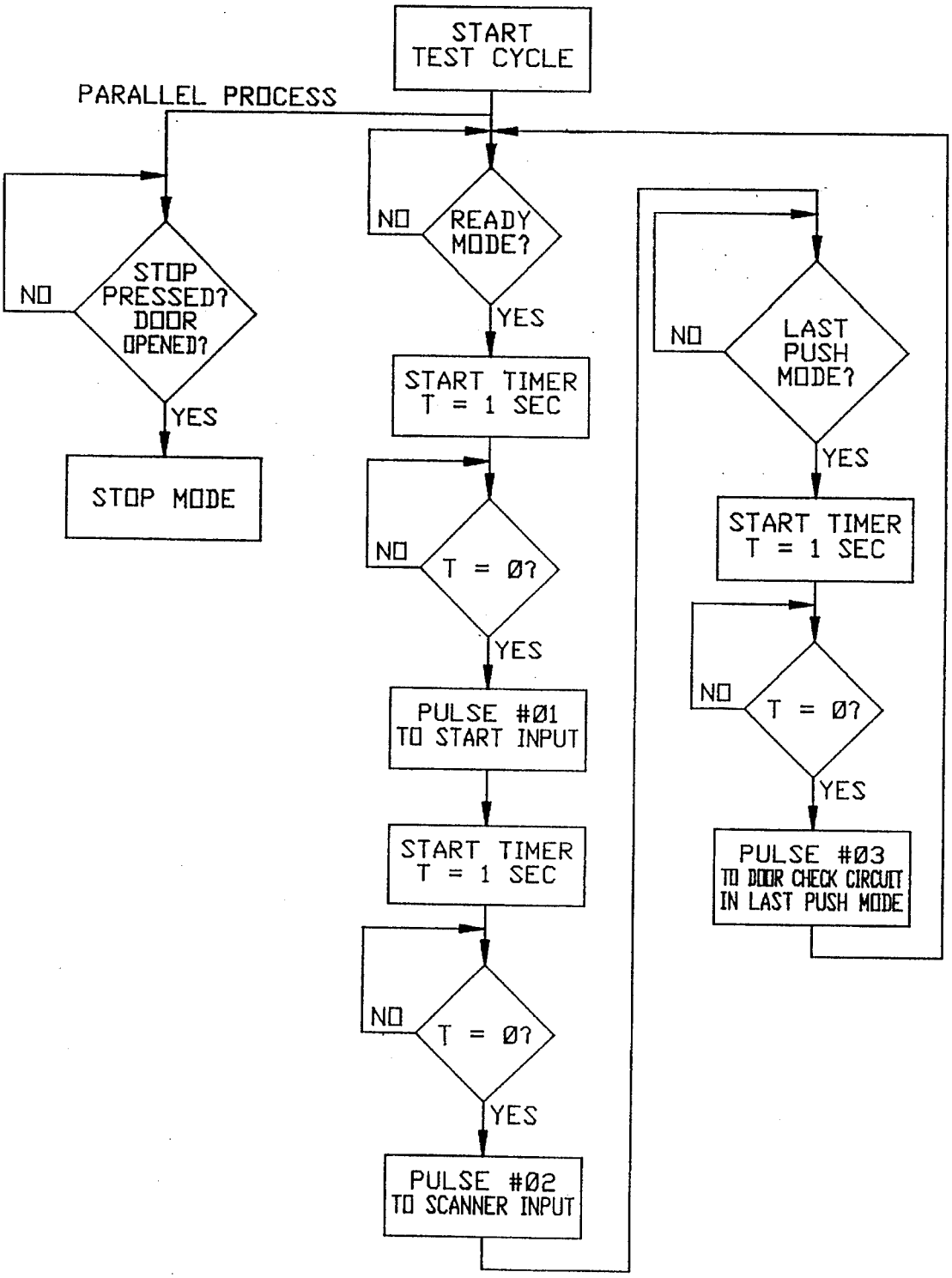

In the illustrated embodiment, cutoff arm drive motor 70 is a one-eighth horsepower DC motor that operates from an input that varies from 0 to 90 VDC. Stepper motor 104 is commercially available and is marketed by Oriental Motors under Model No. PH296-02GK with a six-to-one ratio gear, also marketed by Oriental Motors under Model No. 4GK6KA. Stepper motor 104 produces one-sixth revolution through the gear reducer for each 200 pulses from controller 132, which represents one inch of travel of belt 98. The index speed of belt 98 is six inches per second at 800 pulses per second from controller 130. Microprocessor/ stepper driver includes a central processor unit, or CPU, 160 and optical isolator circuits **162*a*–162*d* for coupling inputs IN01–IN13 to CPU 160 (FIG. 10*a*). CPU 160 supplies a stepper driver circuit 164 with commands, with circuit 164 supplying step 01–06 commands 166 to stepper motor 104 (FIG. 10*b*). CPU 160 drives relays outputs OUT 1–OUT 3 through a buffer circuit 166 and through relays 168*a*–168*d*. CPU 160 drives transistor outputs OUT 5 and OUT 6 through a buffer circuit 170 and through overload devices 172*a* and 172*b*. In the illustrated embodiment, CPU 160 is a model 6800 microprocessor chip set marketed by Motorola, Inc. Stepper driver circuit 164 is marketed by Miquest Corp. under Model MI348. Optical isolator circuits 162***a*–162*d* and buffer circuits 166 and 170 are conventional devices.

Although the invention is illustrated as implemented on a microprocessor control, it is adaptable to being implemented using a programmable logic controller and an intelligent stepper driver to directly actuate stepper motor 104. Such modification would be readily apparent to the skilled artisan.

This novel apparatus can be installed in a small store, bakery, delicatessen, or the like, to enable slices of various thickness to be readily created from a loaf of unsliced bread, enabling a person to cut the bread to a standard one-half inch thickness, a deli one-quarter to three-eighths inch thickness, a garlic bread thickness of up to one inch, or as desired, simply by rotating thumb wheel 114 to the desired setting, placing the loaf of bread on the infeed table, closing cover 80, and engaging start button 118. The slicer knife 24 then repeatedly slices the loaf to the predetermined slice width until the loaf is totally sliced or until the operator stops the machine. Cover 86 is lifted and the sliced bread removed.

The specific embodiment of the invention disclosed above could conceivably be modified in various ways within the scope of the inventive concept, to suit a particular situation. This preferred form of the invention is deemed illustrative, with it being intended that the invention is not to be limited to this specific embodiment depicted, but only by the scope of the appended claims and the reasonably equivalent structures to those defined therein.

The embodiments of the invention in which an exclusive property or privilege is claimed are defined as follows:

1. A variable thickness bread slicing machine that is capable of slicing both crusty and soft breads comprising:

a support surface for a loaf of bread, including an infeed table and an outfeed table;

a circular rotational bread slicing knife;

a support arm rotationally supporting said slicing knife and shiftable to advance said knife from a non-slicing retracted position to a slicing position between, and transverse to, said infeed and outfeed tables, and to return said knife to said retracted position away from said tables and any bread thereon:

arm shifting motor means operably connected to said support arm for shifting said support arm and thereby said knife between said slicing position and said retracted position;

a drive motor that rotationally drives said knife through multiple revolutions during said shifting:

a step-by-step bread pusher shiftable along said infeed table in intermittent increments toward said slicing knife, to advance the bread in intermittent incremental steps of preselected dimension:

a user bread thickness selection device and a control responsive to said selection device to vary the dimension of said increments according to a selected thickness value; and control means for said pusher adjacent said knife and positioned to be actuated when said pusher approaches said knife, and operably connected to said arm shifting motor means to restrain said knife in said retracted position while said pusher travels momentarily past said knife to said outfeed table to push the fully sliced bread loaf completely onto said outfeed table, and subsequently return to said infeed table.

2. The bread slicing machine of claim 1 wherein said arm shifting motor means has a single revolution clutch means for, when actuated, shifting said support arm and knife from said retracted position through said slicing positions and back to said retracted position until again actuated.

3. The bread slicing machine of claim 1 wherein said step-by-step bread pusher includes a pusher plate to advance the bread and a tine assembly to hold bread in contact with said infeed table.

4. The bread slicing machine of claim 3 wherein said tine assembly is coupled with said pusher plate and is arrested prior to reaching the location of said bread slicing knife.

5. A variable thickness bread slicing machine that is capable of slicing both crusty and soft breads comprising:

a support surface for a loaf of bread, including an infeed table and an outfeed table;

a circular rotational bread slicing knife;

a support arm rotationally supporting said slicing knife and shiftable to advance said knife from a non-slicing retracted position to a slicing position between, and transverse to, said infeed and outfeed tables, and to return said knife to said retracted position away from said tables and any bread thereon:

arm shifting motor means operably connected to said support arm for shifting said support arm and thereby said knife between said slicing position and said retracted position;

a drive motor that rotationally drives said knife through multiple revolutions during said shifting;

a step-by-step bread pusher shiftable along said infeed table in intermittent increments toward mid slicing knife, to advance the bread in intermittent incremental steps of preselected dimension;

a stepper motor drive for said bread pusher, said stepper motor drive having capacity to drive varying amounts, and step dimension control means operably associated with said stepper motor drive and said bread pusher for selecting a step dimension of chosen value by varying the drive amount of said stepper motor drive; and a user bread thickness selection device to select a value of said step dimension.

6. The bread slicing machine of claim 5 wherein said arm shifting motor means has a single revolution clutch means for, when actuated, shifting said support arm and knife from said retracted position through said slicing positions and back to said retracted position until again actuated.

7. A variable thickness bread slicing machine that is capable of slicing both crusty and soft breads comprising:

a support surface for a loaf of bread, including an infeed table and an outfeed table;

a circular rotational bread slicing knife;

a support arm rotationally supporting said slicing knife and shiftable to advance said knife from a non-slicing retracted position to a slicing position between, and transverse to, said infeed and outfeed tables, and to return said knife to said retracted position away from said tables and any bread thereon:

arm shifting motor means operably connected to said support arm for shifting said support arm and thereby said knife between said slicing position and said retracted position;

a drive motor that rotationally drives said knife through multiple revolutions during said shifting;

a step-by-step bread pusher shiftable along said infeed table in intermittent increments toward said slicing knife, to advance the bread in intermittent incremental steps of preselected dimension;

a bread thickness selection input;

means responsive to the bread thickness selection input to vary the dimension of said increments comprising variable step dimension control means operably associated with said bread pusher for selecting a step dimension of chosen value; and a stepper motor drive for said bread pusher, said stepper motor drive having capacity to drive varying amounts, and wherein said variable step dimension control means is operably associated with said stepper motor drive and said bread pusher in order to select a step dimension of chosen value by varying the drive amount of said stepper motor drive.

8. The bread slicing machine of claim 7 including:

control means for said pusher adjacent said knife and positioned to be actuated when said pusher approaches said knife, and operably associated with said arm shifting motor means to restrain said knife in said retracted position while said pusher travels momentarily past said knife to said outfeed table to push the fully sliced bread loaf completely onto said outfeed table, and subsequently return to said infeed table, said arm shifting motor means having a single revolution clutch means for, when actuated, shifting said support arm and knife from said retracted position through said slicing positions and back to said retracted position until again actuated.

9. The bread slicing machine of claim 7 wherein said step-by-step bread pusher includes a pusher plate to advance the bread and a tine assembly to hold bread in contact with said infeed table.

10. The bread slicing machine of claim 9 wherein said tine assembly is coupled with said pusher plate and is arrested prior to reaching the location of said bread slicing knife.

11. A variable thickness bread slicing machine that is capable of slicing both crusty and soft breads comprising:

a support surface for a loaf of bread, including an infeed table and an outfeed table;

a circular rotational bread slicing knife;

a support arm rotationally supporting said slicing knife and shiftable to advance said knife from a non-slicing retracted position to a slicing position between, and transverse to, said infeed and outfeed tables, and to return said knife to said retracted position away from said tables and any bread thereon;

arm shifting motor means operably connected to aid support arm for shifting said support arm and thereby said knife between said slicing position and said retracted position;

drive motor that rotationally drives said knife through multiple revolutions during said shifting:

a step-by-step bread pusher shiftable along said infeed table in intermittent increments toward said slicing knife, to advance the bread in intermittent incremental steps of preselected dimension;

a user bread thickness selection device and a control responsive to said selection device to vary the dimension of said increments according to a selected thickness value; and bread sensing means at said infeed surface, adjacent said bread slicing knife, for sensing the leading end of a bread loaf, said bread sensing means being operably associated with said arm shifting motor means to actuate said arm shifting motor means.

* * * * *

UNITED STATES PATENT AND TRADEMARK OFFICE

CERTIFICATE OF CORRECTION

PATENT NO. : 5,461,956
DATED : October 31, 1995
INVENTOR(S) : Bernard L. Petersen et al It is certified that error appears in the above-indentified patent and that said Letters Patent is hereby corrected as shown below:

Column 8, Claim 5, Line 31;
"mid" should be – said –;

Column 10, Claim 11, Line 14;
"aid" should be – said –;

Column 10, Claim 11, Line 18;
Before "drive" insert – a –.

Signed and Sealed this

Eighth Day of October, 1996

*Attest:*

Bruce Lehman

BRUCE LEHMAN

*Attesting Officer*

*Commissioner of Patents and Trademarks*